United States Patent [19]

Pollak

[11] Patent Number: 4,988,010

[45] Date of Patent: Jan. 29, 1991

[54] COMPARTMENTALIZED TRASH CONTAINER

[75] Inventor: Thomas F. Pollak, Ossining, N.Y.

[73] Assignee: Bruce L. Adams, Roseland, N.J. ; a part interest

[21] Appl. No.: 392,203

[22] Filed: Aug. 10, 1989

[51] Int. Cl.[5] ..... B65D 91/00

[52] U.S. Cl. ..... 220/503; 220/909; 220/23.83

[58] Field of Search ..... 220/17, 20, 23.83

[56] References Cited

U.S. PATENT DOCUMENTS

| | | | |
|---|---|---|---|
| 3,856,173 | 12/1974 | Deane et al. | 220/23.83 X |
| 3,893,615 | 7/1975 | Johnson | 220/1 T X |
| 4,729,489 | 3/1988 | Papaianni | 220/20 X |
| 4,775,066 | 10/1988 | Keppeler | 220/20 X |
| 4,834,253 | 5/1989 | Crine | 220/23.83 X |
| 4,834,262 | 5/1989 | Reed | 220/1 T X |
| 4,893,722 | 1/1990 | Jones | 220/909 X |

*Primary Examiner*—Steven M. Pollard
*Attorney, Agent, or Firm*—Bruce L. Adams; Van C. Wilks

[57] ABSTRACT

A compartmentalized trash container having separate compartments for the storing of different kinds of recyclable and non-recyclable trash. The compartmentalized trash container having compartments accessable by slidable draws to permit the introduction and removal of different kinds of trash, and having other compartments accessible through pivotable doors to permit the introduction of other kinds of trash. The container interior being divided into a plurality of separate compartments including at least one upper compartment and at least one lower compartment, each compartment being dimensioned to receive and store therein a preselected kind of trash. Each compartment being individually accessable independently of the others to enable trash to be transferred into and out of the compartment.

17 Claims, 1 Drawing Sheet

COMPARTMENTALIZED TRASH CONTAINER

BACKGROUND OF THE INVENTION

The present invention relates generally to trash containers, and more particularly to compartmentalized trash containers having individual compartments for storing different kinds of recyclable and non-recyclable trash.

The problem of trash disposal is currently of great concern throughout the nation. While it had been common practice to dispose of trash in land and ocean dump sites, this practice has caused untold environmental pollution and has been recently severely curtailed. To lessen the burden of trash disposal, many states and local municipalities have regulations requiring the recycling of trash. Trash recycling is beneficial not only from the standpoint of reducing environmental pollution, but also from the standpoint of energy conservation. Many kinds of trash, for example, aluminum cans, can be recycled and formed into new products at a fraction of the energy required to form the products from raw materials.

To implement trash recycling, the trash must first be separated. Many states and municipalities have laws requiring the separation of trash, and these laws typically require the separation of recyclable glass, metal and paper articles from other non-recyclable kinds of trash. Separating trash for recycling is especially troublesome for residents of homes, apartments and other dwellings due to the shortage of space for sorting, separating and storing different kinds of trash.

SUMMARY OF THE INVENTION

One object of the present invention is to solve the aforementioned problems by providing a compartmentalized trash container having separate compartments for storing different kinds of recyclable and non-recyclable trash.

Another object of the present invention is to provide a compartmentalized trash container which is portable, compact and suitable for use in homes, apartments and other dwellings.

A further object of the present invention is to provide a compartmentalized trash container which is relatively simple and inexpensive to manufacture and which is of rugged, durable construction.

Another object of the present invention is to provide a compartmentalized trash container having compartments accessible by slidable drawers to permit the introduction and removal of different kinds of trash, and having other compartments accessible through pivotable doors to permit the introduction of other kinds of trash.

A still further object of the present invention is to provide a compartmentalized trash container having individual compartments for storing different kinds of trash and having indicia for identifying the kind of trash to be stored in each compartment.

These and other objects of the invention are achieved by a container whose interior is divided into a plurality of separate compartments including at least one upper compartment and at least one lower compartment, each compartment being dimensioned to receive and store therein a preselected kind of trash. Each compartment is individually accessible independently of the others to enable trash to be transferred into and out of the compartments.

In a preferred form, the container has two upper compartments and two lower compartments, the upper compartments being open at their upper ends. The two lower compartments are accessible through slidable drawers which are dimensioned to store therein different kinds of trash, for example, metal articles in one drawer and glass articles in the other. The two open upper compartments contain removable receptacles for storing different kinds of trash, for example, one for storing paper articles and the other for storing non-recyclable trash. The upper compartments are each covered by a removable lid containing a pivotable door so that trash can be inserted into the receptacles through the pivotable doors and the receptacles can be removed from the upper compartments through the open ends thereof upon removal of the lids.

The foregoing as well as other objects, features and advantages of the invention will become apparent to those of ordinary skill in the art upon a reading of the following detailed description of the invention when read in conjunction with the accompanying drawings.

DETAILED DESCRIPTION OF THE INVENTION

Figure 1:
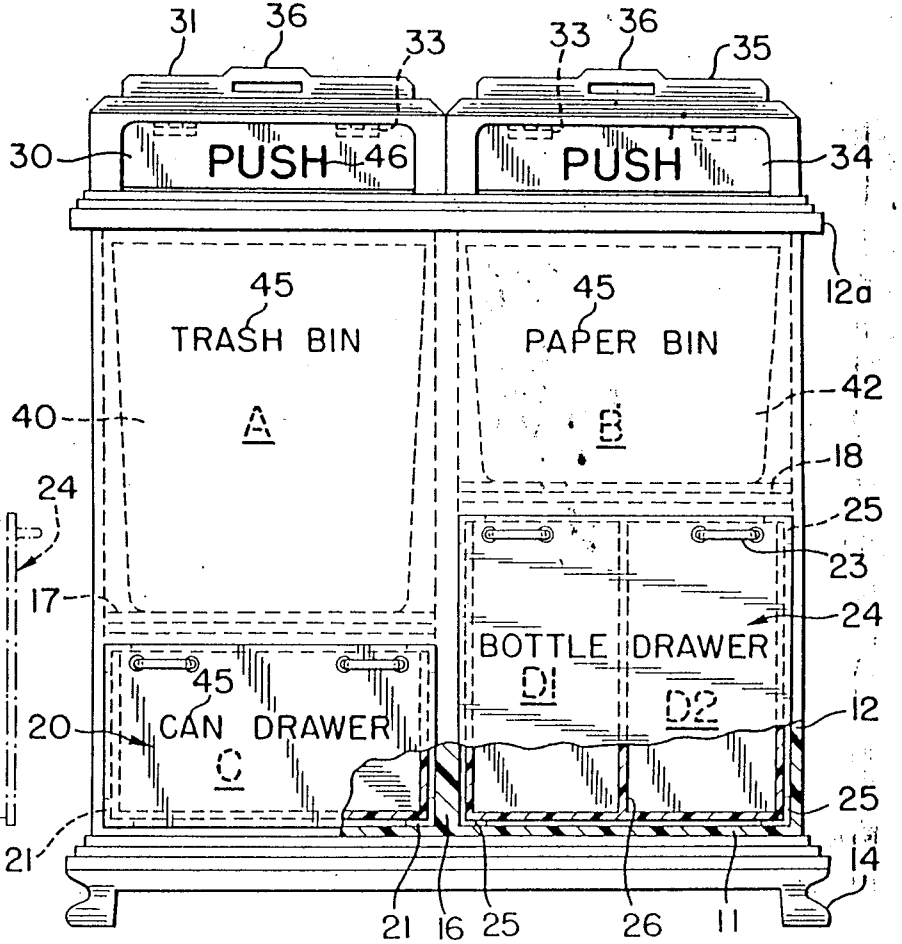
FIG. 1 is a front elevational view, partly in section, showing a compartmentalized trash container constructed according to the principles of the present invention.
Figure 2:
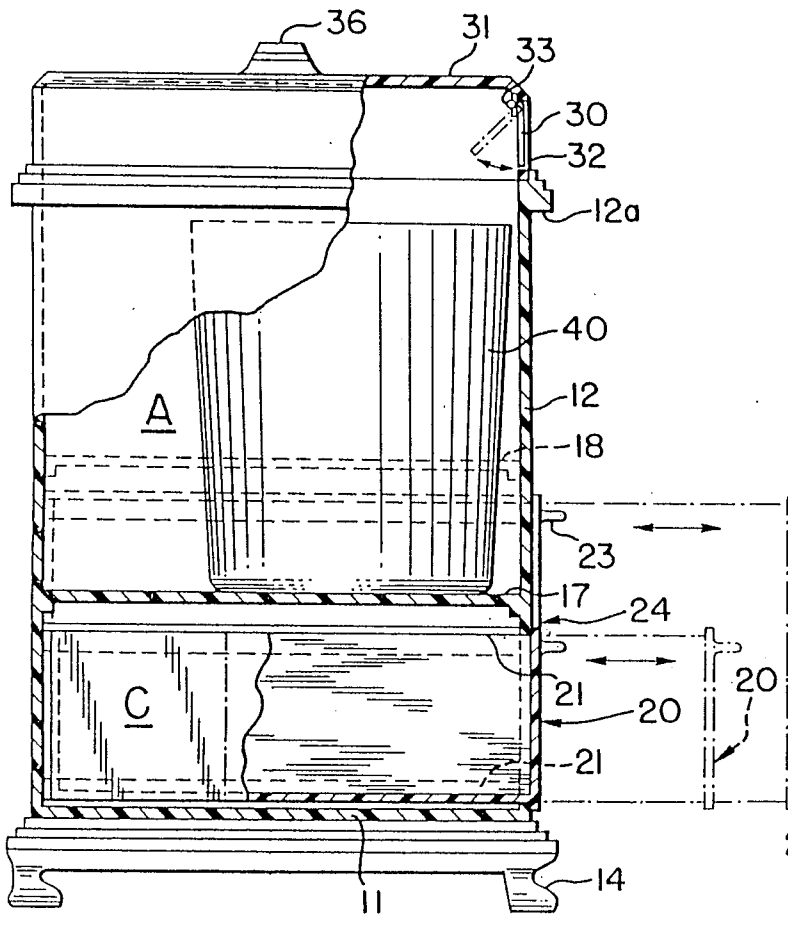
FIG. 2 is a side elevational view, partly in section, of the compartmentalized trash container shown in FIG. 1.

One embodiment of a compartmentalized trash container according to the present invention is shown in FIGS. 1 and 2. The compartmentalized trash container comprises a container 10 having a bottom wall 11 and a side wall 12. The container 10 may have any desired configuration and may be formed of any suitable material, such as plastic, sheet metal, composition board, cardboard or combinations of these materials. In the preferred form, the container 10 is molded from thermoplastic material. To enhance its aesthetic appearance, the container 10 may be provided at its base with a set of ornamental feet 14. The container 10 may be formed of any color and, if desired, may be covered, in whole or in part, with a decorative covering, such as paper or vinyl.

The container 10 is provided with means for dividing the interior thereof into a plurality of separate compartments A, B, C and D. In a preferred form, the dividing means comprises an upstanding partition member 16 which divides the container into lefthand and righthand sections, and lateral partition members 17,18 which divide each section into upper and lower compartments. As shown in FIG. 1, the lateral partition member 17 divides the left container section into an upper compartment A and a lower compartment C, and the lateral partition member 18 divides the right container section into an upper compartment B and a lower compartment D. The partition members 16,17,18 are integrally molded with the bottom and side walls 11,12 and form a one-piece integral unit. As described hereinafter, the plural compartments A,B,C,D are of different sizes and each is dimensioned to accommodate a particular kind of trash.

The container 10 is provided with means for individually accessing each of the compartments A,B,C,D independently of the others to enable trash to be transferred into and out of the respective compartments. In a preferred form, the means for individually accessing the compartments comprises a pair of slidable drawers 20,24, and a pair of pivotable doors 30,34 pivotably mounted on removable lids 31,35.

The slidable drawer 20 is slidably mounted on slideways 21 extending along the length of the lower compartment C. Similarly, the slidable drawer 24 is slidably mounted on slideways 25 extending lengthwise along the lower compartment D. The slideways 21,25 comprise right-angled members having diverging legs which define slideways for guiding the sliding movement of the drawers. The slideways 21,25 are preferably integrally molded with the bottom and sidewalls 11,12 and the partition members 16,17,18. Alternatively, the slideways may be formed as channel members which coact with rollers on the drawers. The drawers 20,24 slidably extend through openings in the front portion of the side wall 12 and abut with the side wall front portion when in the fully closed position, as shown by solid lines in FIG. 2. The drawers are shown in the open position by dot-dash lines in FIG. 2. The drawers 20,24 are likewise preferably molded from plastic and have a box-like shape. The drawers are open at their upper ends to permit trash to be placed therein and removed therefrom. Each drawer is equipped with a pair of handles 23 to permit manual opening and closing of the drawers.

The drawer 20 comprises a can drawer and is dimensioned to receive and store therein recyclable metal cans, such as aluminum soda cans, beer cans, soup cans and the like. The drawer 24 comprises a glass drawer and is dimensioned to receive and store therein recyclable glass articles such as soda bottles, beer bottles, wine bottles and the like. In view of the need of separating colored and clear glass articles, the glass drawer 24 is divided by a partition 26 into two sections D1,D2, one section being for colored glass articles and the other section being for clear glass articles. The glass drawer 24 is preferably of larger size than the can drawer 20 to accommodate the larger size glass articles, such as wine bottles.

The two upper compartments A,B have open upper ends defined by a peripheral flange **12*a* of the sidewall 12. The inner rim of the flange 12*a* is recessed to removably receive therein, as shown in FIG. 2, the lower edge of the lids 31,35. In this manner, the lids are removably attached to the sidewall 12. Each lid is provided with an opening 32, and the pivotable doors 30,34 are pivotably mounted by hinges 33 so as to normally hang downwardly and cover the lid openings 30. The lids 31,35 may be provided with handles 36** to facilitate manual removal and replacement of the lids.

The upper compartment A comprises a trash bin and contains therein a removable receptacle 40 which sits on the lateral partition member 17. The receptacle 40 is configured and dimensioned to be inserted into and withdrawn out of the open upper end of the trash bin A when the lid 31 is removed. The trash bin A is intended to receive non-recyclable trash, such as food wastes and the like. The non-recyclable trash is introduced into the receptacle 40 through the pivotable door 30 which pivots freely inwardly as shown in FIG. 2. To remove the receptacle 40, the lid 31 is removed by manually gripping the handle 36 and, after removal of the lid 31, the receptacle 40 is lifted out of the trash bin A, emptied, and then returned to the trash bin A after which the lid 31 is replaced.

The upper compartment B comprises a paper bin, and a receptacle 42 is removably disposed in the paper bin B and sits on the lateral partition member 18. The receptacle 42 is configured and dimensioned to receive and store therein recyclable paper articles, such as newspapers, magazines and the like. The lid 35 has the same construction as the lid 31. To introduce paper articles into the paper bin B, the paper articles are introduced through the pivotable door 34 and dropped into the paper bin B. To remove the receptacle 42, the lid 35 is removed by manually gripping the handle 36 following which the receptacle 42 is lifted out of the open upper end of the paper bin B. After the paper articles are removed from the receptacle 42, the receptacle is placed back in the paper bin B following which the lid 35 is replaced.

To enable the user to readily determine the particular kind of trash to be placed in each different compartment, the outer side wall 12 of the container 10 is provided with visual indicia 45. The indicia 45 may be in the form of relief lettering molded in the side wall 12 of the container, or may be in the form of printed labels or decals. In the disclosed embodiment, the compartments A,B,C,D bear the identifying indicia "TRASH BIN", "PAPER BIN", "CAN DRAWER" and "BOTTLE DRAWER", respectively. The pivotable doors 30,34 are also provided with the indicia "PUSH". Other indicia may, of course, be used depending on the intended kinds of trash to be stored in the different compartments.

The present invention has been described with reference to one particular embodiment thereof, and obvious variations and modifications will be readily apparent to those of ordinary skill in the art. By way of example, the particular kinds of trash to be stored in the different compartments may vary. One compartment may be used to store plastic trash instead of, or in addition to, the kinds of trash described hereinabove. The present invention is intended to cover all such obvious variations and modifications which fall within the spirit and scope of the appended claims.

I claim:

1. A compartmentalized trash container comprising: a container having bottom and side walls; means dividing the interior of the container into a plurality of separate compartments including at least one upper compartment and at least one lower compartment, each compartment being dimensioned to receive and store therein a preselected kind of trash; and means for individually accessing each of the compartments independently of the others to enable trash to be transferred into and out the compartments, the means for individually accessing the compartments including at least one slidable drawer slidably mounted on slideways in one upper compartment, and at least one pivotable door pivotably mounted on the container adjacent one lower compartment.

2. A compartmentalized trash container according to claim 1; wherein the means dividing the container comprises means dividing the container into two upper compartment and two lower compartments; and the means for individually accessing the compartments comprises a pair of slidable drawers each slidably mounted on slideways in a respective one of the lower compartments, and a pair of pivotable doors each pivotably mounted on the container adjacent a respective one of the upper compartments.

3. A compartmentalized trash container according to claim 5; wherein the two drawers are of different size.

4. A compartmentalized trash container according to claim 3; wherein the smaller drawer comprises a can drawer dimensioned to receive recyclable metal cans.

5. A compartmentalized trash container according to claim 3; wherein the larger drawer comprises a glass drawer dimensioned to receive recyclable glass articles.

6. A compartmentalized trash container according to claim 5; wherein the glass drawer contains therein a partition dividing the glass drawer into two sections, one section being for colored glass articles and the other section being for clear glass articles.

7. A compartmentalized trash container according to claim 2; wherein the two upper compartments are of different size.

8. A compartmentalized trash container according to claim 7; wherein the smaller upper compartment comprises a paper bin dimensioned to receive a stack of recyclable paper articles.

9. A compartmentalized trash container according to claim 8; wherein the smaller upper compartment which defines the paper bin has an open upper end; and the means for accessing the smaller upper compartment comprises a removable lid removably attached to the upper end of the smaller upper compartment, the pivotable door for the smaller upper compartment being pivotably mounted on the lid so that recyclable paper articles may be introduced into the paper bin through the pivotable door and removed from the paper bin through the open upper end thereof upon removal of the lid.

10. A compartmentalized trash container according to claim 9; including a receptacle removably disposed within the paper bin for storing therein paper articles, the receptacle being dimensioned to be inserted into and withdrawn out of the open upper end of the paper bin upon removal of the lid.

11. A compartmentalized trash container according to claim 9; wherein the larger upper compartment comprises a trash bin dimensioned to receive non-recyclable trash.

12. A compartmentalized trash container according to claim 11; wherein the larger upper compartment which defines the paper bin has an open upper end; and the means for accessing the larger upper compartment comprises a removable lid removably attached to the upper end of the larger upper compartment, the pivotable door for the larger upper compartment being pivotably mounted on the lid so that non-recyclable trash may be introduced into the trash bin through the pivotable door and removed from the trash bin through the open upper end thereof upon removal of the lid.

13. A compartmentalized trash container according to claim 12; including a receptacle removably disposed within the trash bin for storing therein non-recyclable trash, the receptable being dimensioned to be inserted into and withdrawn out of the open upper end of the trash bin upon removal of the lid.

14. A compartmentalized trash container according to claim 7; wherein the larger upper compartment comprises a trash bin dimensioned to receive non-recyclable trash.

15. A compartmentalized trash container according to claim 14; wherein the larger upper compartment which defines the trash bin has an open upper end; and the means for accessing the larger upper compartment comprises a removable lid removably attached to the upper end of the larger upper compartment, the pivotable door for the larger upper compartment being pivotably mounted on the lid so that non-recyclable trash may be introduced into the trash bin through the pivotable door and removed from the trash bin through the open upper end thereof upon removal of the lid.

16. A compartmentalized trash container according to claim 15; including a receptacle removably disposed within the trash bin for storing therein non-recyclable trash, the receptable being dimensioned to be inserted into and withdrawn out of the open upper end of the trash bin upon removal of the lid.

17. A compartmentalized trash container according to claim 1; including indicia on the outer side wall of the container for identifying the kind of trash to be placed in each of the compartments.

* * * * *